United States Patent [19]

McNeill et al.

[11] 4,001,631

[45] Jan. 4, 1977

[54] ADJUSTABLE LENGTH CENTER CONDUCTOR FOR TERMINATION FIXTURES FOR ELECTRODELESS LAMPS

[75] Inventors: William McNeill, Carlisle; Joseph Lech, Westford; Paul Haugsjaa, Acton; Robert Regan, Newton, all of Mass.

[73] Assignee: GTE Laboratories Incorporated, Waltham, Mass.

[22] Filed: Nov. 17, 1975

[21] Appl. No.: 632,328

Related U.S. Application Data

[63] Continuation-in-part of Ser. No. 570,109, May 21, 1975, Pat. No. 3,943,403.

[52] U.S. Cl. ..... 315/39; 313/182; 315/248; 315/267; 315/344; 333/33

[51] Int. Cl.[2] ..... H01J 7/46; H01J 19/80

[58] Field of Search ..... 315/227, 248, 267, 268, 315/344, 39; 313/44, 182; 333/32, 33

[56] References Cited

UNITED STATES PATENTS

| | | | |
|---|---|---|---|
| 3,787,705 | 1/1974 | Bolin et al. | 315/248 |
| 3,873,884 | 3/1975 | Gabriel | 315/267 |
| 3,943,401 | 3/1976 | Haugsjaa et al. | 315/248 |
| 3,943,402 | 3/1976 | Haugsjaa et al. | 315/248 |
| 3,943,403 | 3/1976 | Haugsjaa et al. | 315/248 |

*Primary Examiner*—Saxfield Chatmon, Jr.
*Attorney, Agent, or Firm*—Irving M. Kriegsman; Leslie J. Hart

[57] ABSTRACT

A light source includes a source of high frequency power, an electrodelsss lamp and a termination fixture for coupling power to the lamp, the fixture having an outer conductor and an inner conductor whose length is adjustable for providing dynamic matching of the impedance of the lamp during the operating mode to the output impedance of the source. Variations in the power level from the source, such as is desirable in providing lamp brightness selectivity, vary both the real and imaginary components of the lamp impedance, and corresponding adjustments of the inner conductor length provide a tuning technique to compensate for these variations.

11 Claims, 4 Drawing Figures

ADJUSTABLE LENGTH CENTER CONDUCTOR FOR TERMINATION FIXTURES FOR ELECTRODELESS LAMPS

CROSS-REFERENCE TO RELATED PATENT APPLICATION

This patent application is a continuation in part of application Ser. No. 570,109 in the names of Haugsjaa, Regan, McNeill and Lech for IMPROVED ELECTRODELESS LIGHT SOURCE UTILIZING A LAMP TERMINATION FIXTURE HAVING A PARALLEL CAPACITIVE IMPEDANCE MATCHING CAPABILITY, filed Apr. 21, 1975, and assigned to the same assignee as in the present patent application now U.S. Pat. No. 3,943,403.

BACKGROUND OF THE INVENTION

The present invention relates to electrodeless light sources excited by high frequency power and, more specifically, to techniques and apparatus for optimizing the transfer of power from a source to the lamp.

Historically, there have been three methods of exciting discharges with electrodes. The first uses the discharge as a lossy part of either the capacitance or inductance of a tank circuit. A second method is to place the lamp in the path of radiation from a directional antenna. A third method uses a resonant cavity which contains the lamp and a device for matching the cavity impedance to the source and transmission line. Examples of a device according to this third method may be found in "Microwave Discharge Cavities Operating at 2450 MHz" by F. C. Fehsenfeld et al., Review of Scientific Instruments, Volume 36, Number 3, (March, 1965). Another example of a resonant cavity device is described in the U.S. Pat. No. 3,787,705 to Bolin.

All of these methods have disadvantages which limit their use as a possible replacement for the conventional incandescent light bulb. One feature of the electrode-containing source is the capability of brightness selectivity control, such as with a potentiometer. An electrodeless lamp containing a fill material that emits light upon breakdown and excitation may have an impedance in the operating mode having both an imaginary and a real component. Further, each component may vary with the power applied to the lamp. Thus, some technique is desirable to optimize the transfer of power from the source to the lamp when the source-power level is adjustable.

SUMMARY OF THE INVENTION

It is an object of the present invention to provide an electrodeless light source which can be dynamically tuned for optimal power transfer to the lamp in response to variations in the power level supplied to the lamp.

According to the present invention, a light source includes a source of power at a high frequency, an electrodeless lamp having an envelope made of a light transmitting substance, the envelope enclosing a volatile fill material which emits light upon breakdown and excitation, and a termination fixture coupled to the source, the fixture having an inner conductor and an outer conductor disposed around the inner conductor. The conductors have a first end which is coupled to the source, and the inner conductor has a second end which couples power to the lamp. Accordingly, a device is provided for changing the effective length of the inner conductor so that the termination fixture transforms the complex impedance of the lamp during the operating condition to the output impedance of the power source.

Preferably, although not necessarily, this device is used in conjunction with a variable reactive impedance element, such as a variable capacitance, at the fixture input for matching the reactive part of the lamp impedance to the output impedance of the source.

There are several exemplary forms of the inner conductor length changing device. In one form, the length of the inner conductor changes with respect to the outer conductor, the inner conductor being the crucial length in determining proper matching. The inner conductor is subdivided into two sections, one of which moves from an aperture in the other section. In one form, the mating sections are threaded and the inner conductor length variation is accomplished by rotating the lamp-coupling section with respect to the input power-coupling section. In another exemplary embodiment, the lamp-coupling section is translated through the use of a lever arm disposed through an aperture in the outer conductor and pivotally affixed to the lamp-coupled section of the inner conductor. In still another form of the invention, the outer conductor is moved with respect to the inner conductor so as to cause an effective change in length of the inner conductor.

GENERAL CONSIDERATIONS

Figure 1:
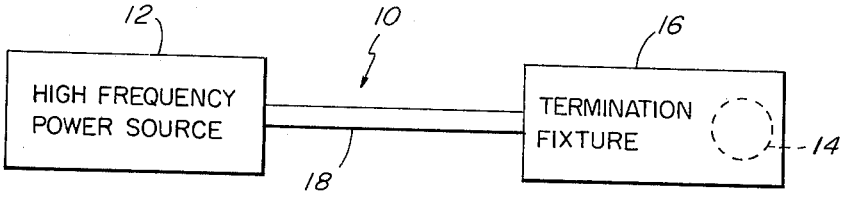
FIG. 1 is a block diagram of the light source of the type incorporating the principles according to the present invention.

In order for a termination fixture to be able to match a variety of electrodeless lamps, some tuning device is necessary. The present invention relates to a means whereby this tuning is accomplished by changing the effective length of the termination fixture and more specifically, the distance between the lampcoupled end of the inner conductor and the power source coupled end of both conductors. This tuning scheme, used by itself or in conjunction with other tuning elements, enables the fixture to be adjusted to transfer all applied power to the lamp.

In general, a characteristic impedance and a line length can be found for matching a complex load impedance $Z_L$ into some other impedance $R_S$, a real value. The function of the termination fixture is to provide a match between an operating lamp of impedance $Z_L = R + jX$ and a source with output impedance $R_S$. If the fixture characteristic impedance is $$Z_c = \left( R_S R + \frac{R_S X^2}{R - R_S} \right)^{1/2}$$

and its length is $$l = \frac{1}{2\pi} \tan^{-1} \frac{Z_c(R_S - R)}{R_S X}$$

a match will be achieved. The characteristic impedance of a coaxial line type of termination fixture is given by:

$$Z_c = \frac{138}{\sqrt{\epsilon_r/\mu_r}} \log \frac{b}{a}$$

where $\epsilon_r$ = dielectric constant of the medium between the conductors $\mu_r$ = permeability of the medium between the conductors $b$ = inner diameter of the outer conductor $a$ = diameter of the inner conductor If X = 0, i.e., the lamp has a purely real impedance, the equations above reduce to the equations for a quarter-wave fixture, $Z_c = \sqrt{R_S R}$ $$l = \frac{\lambda}{4}.$$

For X small, the characteristic impedance is still approximately that required for the quarter-wave fixture but a different length is required. Thus, a slight change in fixture length will tune the fixture for a slightly complex load.

Parent patent application, Ser. No. 570,109, filed Apr. 21, 1975, now U.S. Pat. No. 3,943,403 describes a tunable parallel capacitor at the input to a termination fixture for tuning. However, the extent to which a termination fixture can be tuned by this one element is not unlimited. The parallel capacitor affects only the imaginary part of the input admittance ($=1/Z_i$) by adding the value $B = \omega C$, where C is the capacitance and $\omega$ the angular frequency. Both real and imaginary components are affected by the fixture length, however, so that if C and $l$ are both variable, a perfect match may be made.

In a similar fashion, an adjustable length center conductor is suitable for use in a termination fixture with a two-section center conductor, such as a quarter-wave and eighth-wave or the three-section fixture which patent application Ser. No. 570,055, filed Apr. 21, 1975, now U.S. Pat. No. 3,943,402 describes. Further, an adjustable length center conductor could be used to match a complex lamp impedance to a complex source impedance, such as the output impedance of a high frequency semiconductor device.

DESCRIPTION OF PREFERRED EMBODIMENTS

Figure 2:
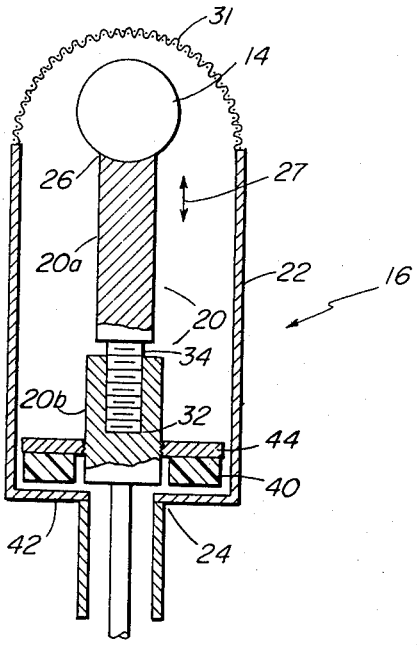
FIG. 2 is a partial sectional view of a termination fixture having an adjustable length inner conductor according to the present invention.

In an exemplary embodiment of the present invention, as shown in FIG. 1, a light source, indicated by the reference numeral 10, includes a source 12 of power at a high frequency, an electrodeless lamp 14 and a termination fixture 16 coupled to the source, such as by a transmission cable 18. As used herein, the phrase "high frequency" is intended to include frequencies in the range generally from 10 MHz to 300 GHz. Preferably, the frequency is in an ISM band (i.e., industrial, scientific and medical band) one of which ranges from 902 MHz to 928 MHz. In the embodiment of FIG. 2, the frequency used was 915 MHz. One of many commercially available power sources which may be used is an Airborne Instruments Laboratory Power Signal Source, type 125. The lamp 14 has an envelope made of a light transmitting substance, such as quartz. The envelope encloses a volatile fill material which emits light upon excitation and breakdown. The following are specific examples of lamps and fill materials which may be used.

EXAMPLE I

Fill Material
- 9.1 mg. mercury
- 10 torr of argon

Envelope
- Quartz sphere having a 15 mm. ID

EXAMPLE II

Fill Material
- 8.9 mg. of mercury
- 1.5 mg. of $ScI_3$
- 1.7 mg. of NaI
- 20 torr of argon Envelope
- Quartz sphere having a 15 mm. ID

EXAMPLE III

Another fill material is 2 or 3 atoms of sodium for each mercury atom to yield under operating conditions 200 torr sodium partial pressure and about 1,000 torr mercury partial pressure. The envelope is a material which is resistant to sodium such as translucent $A1_2O_3$.

Referring now to FIG. 2, the termination fixture 16 has an inner conductor, represented generally by the reference numeral 20, and an outer conductor 22 disposed around the inner conductor. The conductors 20 and 22 have a first end 24 which is coupled to the source 12, and the inner conductor 20 has a second end 26 which is coupled to the lamp 14. A shield 31 is disposed over the opening formed by the end of the outer conductor. According to the invention, the termination fixture has a device for changing the effective length of the inner conductor 20 so that the termination fixture 16 matches the complex impedance of the lamp during the operating condition to an output impedance of the power source 12. As used herein, the effective length of the inner conductor is the distance from the first end to the second end of the inner conductor 20. As will be described in more detail hereinafter, the device for changing the length of the inner conductor involves a technique for changing the length of the inner conductor with respect to the outer conductor along a longitudinal axis 27 of the termination fixture 16. In FIG. 2, the inner conductor 20 includes a first section **20*a* and a second section 20*b*. The first section 20*a* has the end 26 which couples power to the lamp. Also, the sections 20*a* and 20*b* have mutually telescopically engaging ends to permit variations in the total length of the inner conductor while maintaining electrical contact between the sections. Preferably, this is accomplished by one of the sections being formed with an aperture which is sized to receive an end of the other of the sections. For example, the section 20*b* is formed with an aperture 32** which receives a lower end 34 of the inner conductor 20*a*. The end 34 and the material of the section 20*b* forming the aperture 32 are provided with mutually engaging threads. In operation, the first section may be rotated to vary the total length of the inner conductor 20.

Preferably, the fixture in FIG. 2 includes a device for rotating the first section 20*a* externally to the fixture so that the overall length may be dynamically adjusted. Such a device (not shown) may include a gear arrangement such as a worm gear which engages a pinion gear mounted around the first section 20*a* of the inner conductor. The worm gear is mounted in a pair of apertures in the outer conductor so that the worm gear is mounted adjacent to the first section 20*a*. Both the worm gear and pinion gear are made of a non-conductive material. In operation, as the pinion gear is turned, the length of the inner conductor is varied.

Preferably, the adjustable length inner conductor concept of the present invention is used in conjunction with an adjustable parallel plate capacitance which the parent patent application Ser. No. 570,109, filed Apr. 21, 1975, describes. This adjustable capacitor is illustrated generally by a dielectric layer 40 disposed between an outer conductor end plate 42 and an adjustable, threaded plate 44 in contact with the inner conductor. This adjustable capacitance at the fixture input provides a means of matching the capacitive impedance part of the load (i.e., the lamp) to the output impedance of the source. For additional details, reference is made to the parent patent application which is herein incorporated by reference.

Figure 3:
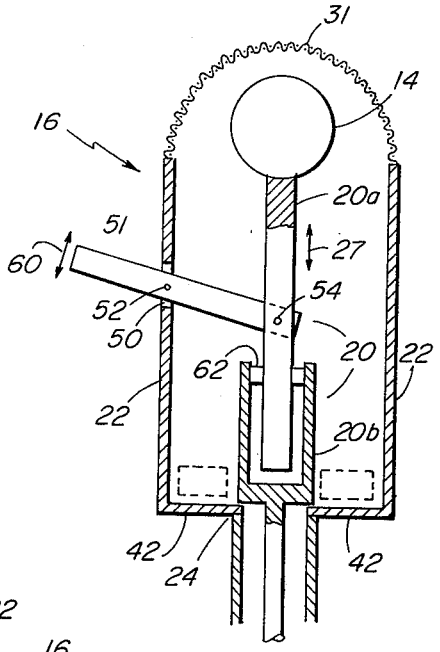
FIG. 3 is a partial sectional view of an alternative embodiment of a termination fixture having an adjustable length inner conductor according to the present invention.

Referring now to FIG. 3, there is shown another embodiment of a device for moving the inner conductor 20. The outer conductor 22 is formed with an aperture 50, and a lever arm 51, made of a non-conducting material such as bakelite or teflon is disposed through the aperture 50. The lever arm 51 is pivotally affixed at 52 to the outer conductor and also pivotally affixed at 54 to the first section 20a of the inner conductor 20. In operation, movement of the lever arm 51 in either of the directions indicated by the arrows 60 causes a translational movement along the longitudinal axis 27 of the inner conductor 20. Preferably, a spring contact, represented by the reference numeral 62, made of a non-corrosive material, such as silver plated nickel or spring steel, is disposed between the first and second sections of the inner conductor 20 to maintain electrical contact therebetween as the first section 20a is translated.

Figure 4:
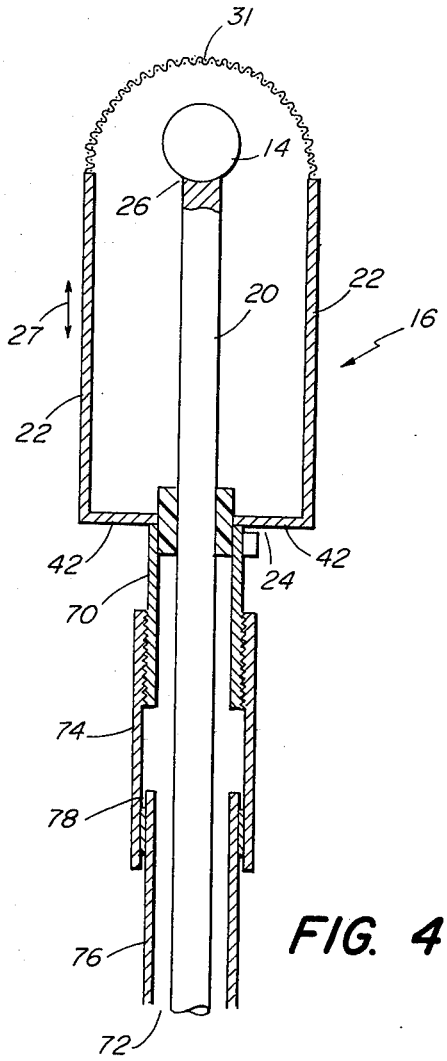
FIG. 4 is a partial sectional view of another alternative embodiment of a termination fixture having an adjustable length inner conductor according to the present invention.

Referring now to FIG. 4, there is shown an embodiment where the length changing device comprises a device for moving the outer conductor 22 with respect to the inner conductor 20 so as to cause an effective change in the length of the inner conductor 20. An externally threaded conductive tube 70 extends from the first end 24 of the termination fixture, particularly from the end plate 42. The tube 70 is disposed around the inner conductor which, as illustrated in FIG. 4, has a uniform diameter throughout its length which extends from the second end 26 to a power coupling connector (not shown) at 72. An internally threaded conductive tube 74 is disposed around the inner conductor and is in engagement with the threads of the externally threaded tube 70. A power coupling conductive tube 76 extends from the power connected (not shown) and is rigidly affixed in position with respect to the inner conductor 20. A device 78, such as a rotating electrical contactor, maintains electrical contact between the power coupling tube 76 and the tube 74 while the tube 74 is rotating. This permits the outer conductor to move with respect to the inner conductor while still maintaining uniform electrical continuity. The result of this movement is to change the effective length of the inner conductor 20.

The embodiments of the present invention are intended to be merely exemplary and those skilled in the art shall be able to make numerous variations and modifications of them without departing from the spirit and scope of the present invention. All such variations and modifications are intended to be within the scope of the present invention as defined by the appended claims.

We claim:

1. A light source including:
   a. a source of power at a high frequency,
   b. an electrodeless lamp having an envelope made of a light transmitting substance, the envelope enclosing a volatile fill material which emits light upon breakdown and excitation, the lamp having a complex impedance in the operating condition,
   c. a termination fixture coupled to the source, the fixture having an inner conductor and outer conductor disposed around the inner conductor, the conductors, having a first end which is coupled to the source and the inner conductor having a second end which couples power to the lamp, and
   d. means for changing the effective length of the inner conductor so that the termination fixture matches the complex impedance of the lamp during the operating condition to an output impedance of the power source.

2. The light source according to claim 1 wherein the length changing means includes means for changing the length of the inner conductor with respect to the outer conductor along a longitudinal axis of the termination fixture.

3. The light source according to claim 2 wherein the inner conductor length changing means includes:
   a. first and second inner conductor sections disposed along the longitudinal axis, the sections further having mutually telescopically engaging end means to permit variations in total length of the inner conductor while maintaining electrical contact between the sections.

4. The light source according to claim 3 further including means external to the fixture for moving the first section with respect to the second section while the lamp is in the operating condition.

5. The light source according to claim 3 wherein the telescopically engaging end means includes:
   a. one end of one of the sections being formed with an aperture sized to receive an end of the other of the sections.

6. The light source according to claim 5 further including mutually engaging threads on the inner wall of the end forming the aperture and on the outer walls of the aperture engaging end so that the length of the inner conductor may be varied by rotating the first section with respect to the second section, and wherein the means for moving the first section includes means for rotating the first section with respect to the second section.

7. The light source according to claim 4 wherein the means for moving the first section includes:
   a. the outer conductor being formed with an aperture, b. a lever arm made of a non-conducting material disposed through the aperture and having an outer end affixed to the first section of the inner conductor, and c. the lever arm being pivotally affixed at the aperture to the outer conductor so movement of the outer end of the lever arm causes a translational movement of the first section of the inner conductor.

8. The light source according to claim 7 further including a spring contactor made of non-corrosive material disposed between the first and second sections of the inner conductor to maintain electrical contact between the sections as the first section is translated.

9. The light source according to claim 1 wherein the length changing means includes means for moving the outer conductor with respect to the inner conductor.

10. The light source according to claim 9 wherein the outer conductor moving means includes:

a. an externally threaded conductive tube extending from the first end of the outer conductor and being disposed around the inner conductor, b. an internally threaded conductive tube in engagement with the threads of the externally threaded tube, c. a power coupling outer conductor tube; and d. means for maintaining electrical contact between the power coupling tube and the internally threaded tube while the internally threaded tube rotates so that the outer conductor moves with respect to the inner conductor.

11. A light source including:

a. a source of power at a high frequency, b. an electrodeless lamp having an envelope made of a light transmitting substance, the envelope enclosing a volatile fill material which emits light upon breakdown and excitation, the lamp having a complex impedance whose real and imaginary components vary in response to the power level, c. a termination fixture coupled to the source, the fixture having an inner conductor and outer conductor disposed around the inner conductor, the conductors having a first end which is coupled to the source and the inner conductor having a second end which is coupled to the lamp, d. variable parallel capacitance means at the first end of the termination fixture for matching the imaginary impedance component of the lamp to the output impedance of the source, and e. means for changing the effective length of the inner conductor so that the termination fixture matches the complex impedance of the lamp during the operation condition to an output impedance of the power source.

* * * * *

UNITED STATES PATENT OFFICE

CERTIFICATE OF CORRECTION

Patent No. 4,001,631 Dated January 4, 1977

Inventor(s) William McNeill et al.

It is certified that error appears in the above-identified patent and that said Letters Patent are hereby corrected as shown below:

Col. 3, lines 5-10, the equation should read:

$$-- \quad \ell = \frac{\lambda}{2\pi} \tan^{-1} \frac{Z_C(R_S - R)}{R_S X} \quad --$$

Signed and Sealed this

*fifth* Day of *July 1977*

[SEAL]

*Attest:*

RUTH C. MASON
*Attesting Officer*

C. MARSHALL DANN
*Commissioner of Patents and Trademarks*